US005607072A

United States Patent [19]

Rigney et al.

[11] Patent Number: 5,607,072

[45] Date of Patent: Mar. 4, 1997

[54] BEVERAGE CONTAINERS

[75] Inventors: Patrick Rigney, Dublin, Ireland; Colin Purdy, Bishop's Stortford, England

[73] Assignee: Gilbeys of Ireland (Manufacturing) Limited, Dublin, Ireland

[21] Appl. No.: 341,041

[22] Filed: Nov. 15, 1994

Related U.S. Application Data

[63] Continuation of Ser. No. 97,042, Jul. 27, 1993, abandoned.

[30] Foreign Application Priority Data

Mar. 5, 1993 [IE] Ireland ..... 93 0167

[51] Int. Cl.[6] ..... B65D 21/024; B65D 23/08

[52] U.S. Cl. ..... 215/10; 215/6; 215/386; 215/365; 206/431; 220/23.2; 220/23.83

[58] Field of Search ..... 215/6, 10, 100 R, 215/12.1, 365, DIG. 8, 386; 220/23.4, 23.2, 23.83, 23.86; 206/213, 430, 431; 222/129, 158

[56] References Cited

U.S. PATENT DOCUMENTS

| | | | |
|---|---|---|---|
| 132,020 | 10/1872 | Odell | 215/6 |
| 146,783 | 1/1874 | Richardson | 215/10 |
| 284,127 | 8/1883 | Gruenebaum | 215/6 X |
| 582,380 | 5/1897 | Terbutt | 215/DIG. 8 |
| 666,090 | 1/1901 | Dryfoos | 215/10 |
| 825,680 | 7/1906 | Raymond | 215/6 |
| 2,001,798 | 5/1935 | Shreiber | 206/813 X |
| 2,013,382 | 9/1935 | Garwood | 215/6 X |
| 2,661,870 | 12/1953 | Huenergardt | 215/6 X |
| 2,665,816 | 1/1954 | Anft | 215/6 X |
| 3,114,496 | 12/1963 | Wilcox | 206/431 X |
| 3,160,341 | 12/1964 | Cherney | 206/813 X |
| 3,194,426 | 7/1965 | Brown, Jr. | 220/23.4 |
| 3,197,071 | 7/1965 | Kuster | 215/6 X |
| 3,269,389 | 8/1966 | Meurer | 215/6 X |
| 3,347,420 | 10/1967 | Donoghue | 222/129 |
| 3,369,658 | 2/1968 | Hasselmann | 206/431 X |
| 3,467,269 | 9/1969 | Newton | 215/6 |
| 3,727,800 | 4/1973 | Santos | 222/129 |
| 3,759,373 | 9/1973 | Werth et al. | 220/23.4 X |
| 3,948,105 | 4/1976 | Johnson, Jr. | 215/365 X |
| 4,139,114 | 2/1979 | Long et al. | 215/10 X |
| 4,165,812 | 8/1979 | Jennison | 215/10 |
| 4,196,808 | 4/1980 | Pardo | 215/6 X |
| 4,293,084 | 10/1981 | Lussier | 215/365 X |
| 4,646,948 | 3/1987 | Jennings | 222/158 X |
| 4,685,565 | 8/1987 | Sparling | 215/10 X |
| 4,762,251 | 8/1988 | Berger | 222/129 X |
| 4,776,972 | 10/1988 | Barrett | 215/6 X |
| 4,860,927 | 8/1989 | Grinde | 222/158 |
| 4,889,255 | 12/1989 | Schiemann | 215/16 X |
| 4,950,083 | 8/1990 | Bavaveas | 215/10 X |
| 5,007,540 | 4/1991 | Beasley | 206/813 X |
| 5,143,261 | 9/1992 | Drobish | 222/129 |
| 5,154,917 | 10/1992 | Ibrahim et al. | 222/129 X |
| 5,158,191 | 10/1992 | Douglas et al. | 220/23.4 X |
| 5,158,209 | 10/1992 | Reil et al. | 222/129 |

FOREIGN PATENT DOCUMENTS

| | | | |
|---|---|---|---|
| 504797 | 8/1954 | Canada | 215/6 |
| 488941 | 3/1992 | European Pat. Off. . | |
| 595572 | 10/1925 | France | 215/6 |
| 366638 | 6/1923 | Germany | 215/6 |
| 827537 | 1/1952 | Germany | 215/6 |
| 865810 | 2/1953 | Germany | 222/158 |
| 3030290 | 4/1982 | Germany | 206/430 |
| 3616207 | 11/1987 | Germany | 222/129 |
| 500652 | 11/1954 | Italy | 215/6 |
| 515340 | 2/1955 | Italy | 215/6 |
| 606138 | 6/1960 | Italy | 215/6 |
| 2970 | 8/1877 | United Kingdom | 215/6 |
| 940326 | 10/1963 | United Kingdom | 215/6 |
| 1060361 | 3/1967 | United Kingdom | 215/6 |
| 1360729 | 7/1974 | United Kingdom | 215/6 |
| 2221666 | 2/1990 | United Kingdom | 215/100 R |

*Primary Examiner*—Sue A. Weaver

*Attorney, Agent, or Firm*—Jacobson, Price, Holman & Stern, PLLC

[57] ABSTRACT

A liquid container 1 comprises a larger glass bottle 2 and a smaller glass bottle 3 which are separately formed and adhesively bonded together. A base 11 of the smaller bottle 3 is spaced slightly above the base 10 of the larger bottle 2 so that in use, the base 10 of the larger bottle 2 forms a standing surface for the container 1 to prevent rocking.

6 Claims, 4 Drawing Sheets

BEVERAGE CONTAINERS

This is a Continuation of application Ser. No. 08/097,042, filed Jul. 27, 1993 which was abandoned.

BACKGROUND OF THE INVENTION

The invention relates to beverage containers.

In conventional beverage systems a liquid beverage is provided as a single liquid in a bottle. There have been attempts to provide immiscible or non-homogeneous liquids in a bottle, however, such systems require a consumer to mix the contents of the bottle prior to pouring to ensure that a homogeneous product is obtained.

SUMMARY OF THE INVENTION

This invention is directed towards providing a novel beverage container system which may be used particularly for delivering a combination beverage product.

According to the invention there is provided a liquid container having at least two separate compartments for different beverages which are to be poured to provide a combination beverage product.

In a preferred embodiment of the invention the container has two separate compartments.

In one arrangements the compartments are of different capacities. The fill ratio of the two compartments is most preferably approximately 2:1.

In one embodiment of the invention each compartment is separately formed, the compartments being bonded together to form the container.

In a preferred arrangement the compartments are defined by glass bottles which are bonded, typically by adhesives, to form the container.

In one embodiment of the invention each bottle compartment comprises a base portion, a main body portion and a pouring neck portion.

Preferably the base portion of one of the bottles is spaced upwardly from the base portion of the other bottle to spread the load and prevent rocking of the container, in use. Most preferably, the cross-sectional area of one of the base portions is larger than the other and the load of the container is supported by the larger base portion.

In one embodiment of the invention the neck portion of the bottles are adapted to receive cork stoppers.

In another embodiment of the invention the neck portions of the bottles are adapted to be sealed by screw type closures.

In a preferred arrangement each bottle includes a recess portion in the outer surface thereof to receive a label.

BRIEF DESCRIPTION OF THE DRAWINGS

The invention will be more clearly understood from the following description thereof given by way of example only with reference to the accompanying drawings in which.

DESCRIPTION OF THE PREFERRED EMBODIMENTS

Figure 1:
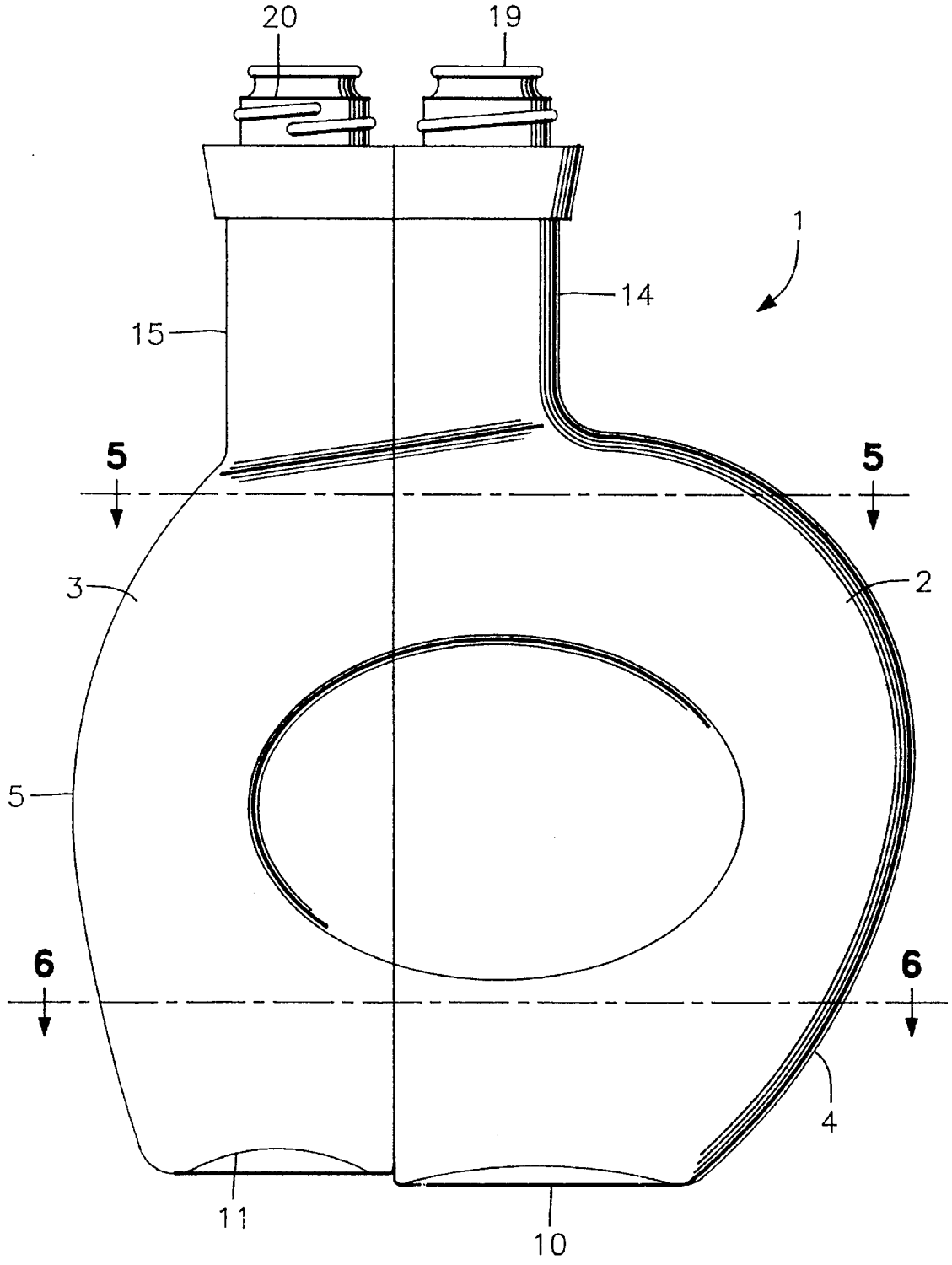
FIG. 1 is a front elevational view of a container according to the invention.
Figure 2:
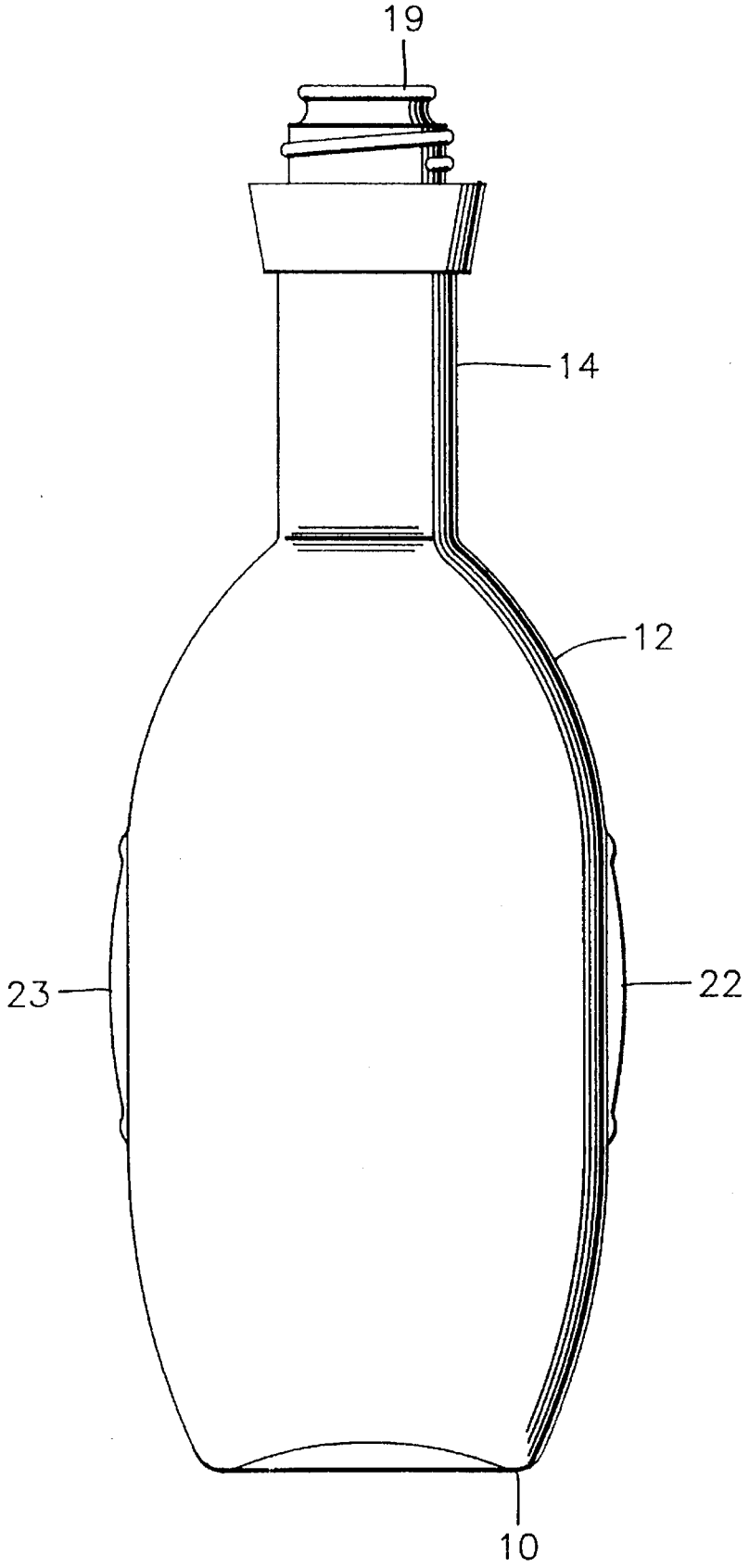
FIG. 2 is a side elevational view of the container.
Figure 3:
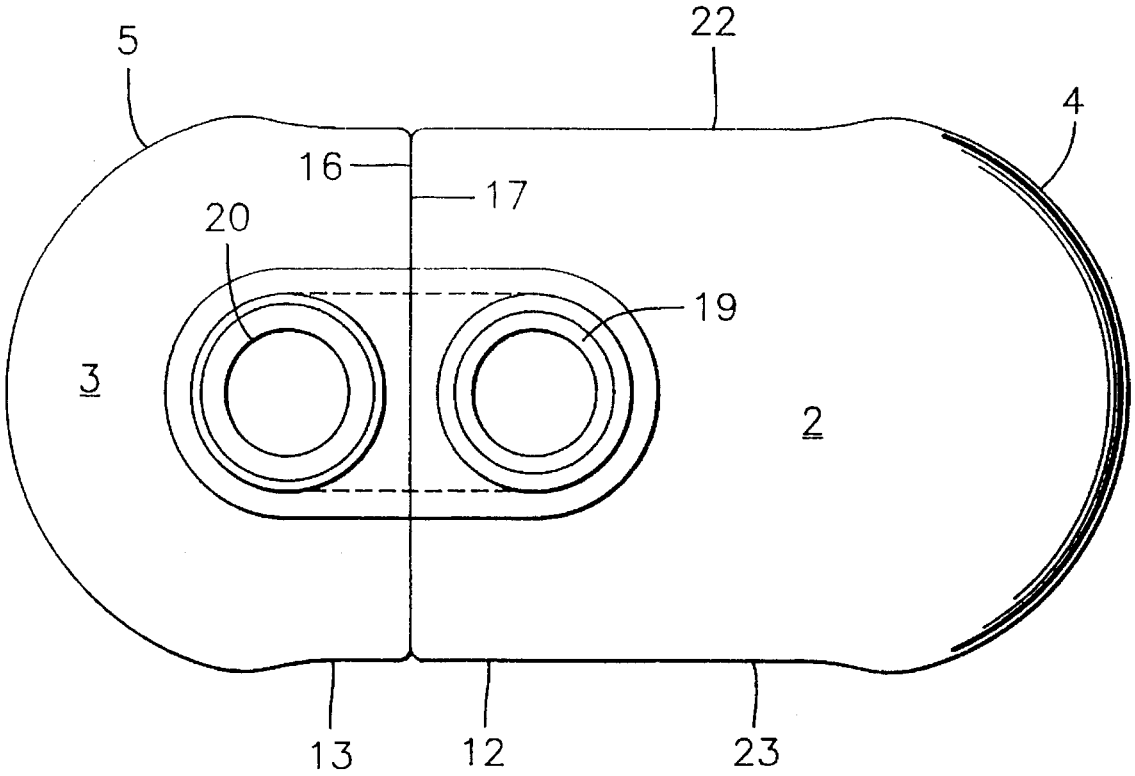
FIG. 3 is a top plan view of the container.
Figure 4:
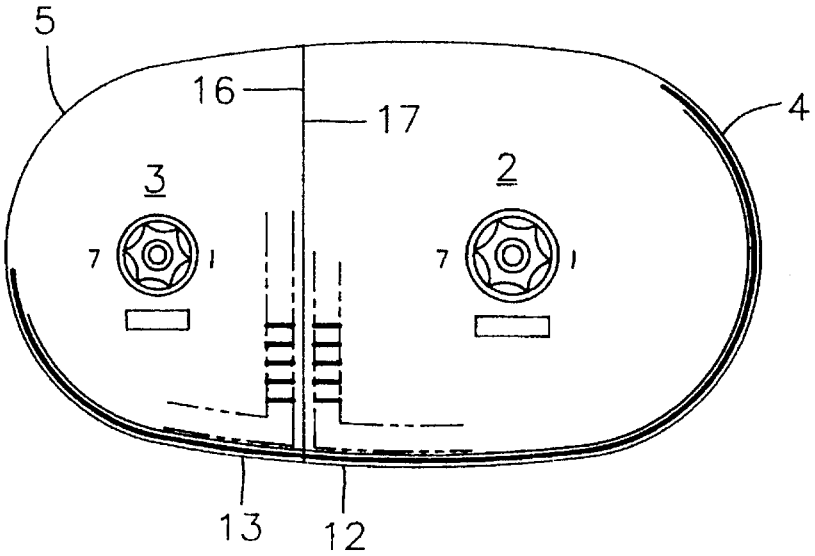
FIG. 4 is an underneath view plan view of the container.
Figure 5:
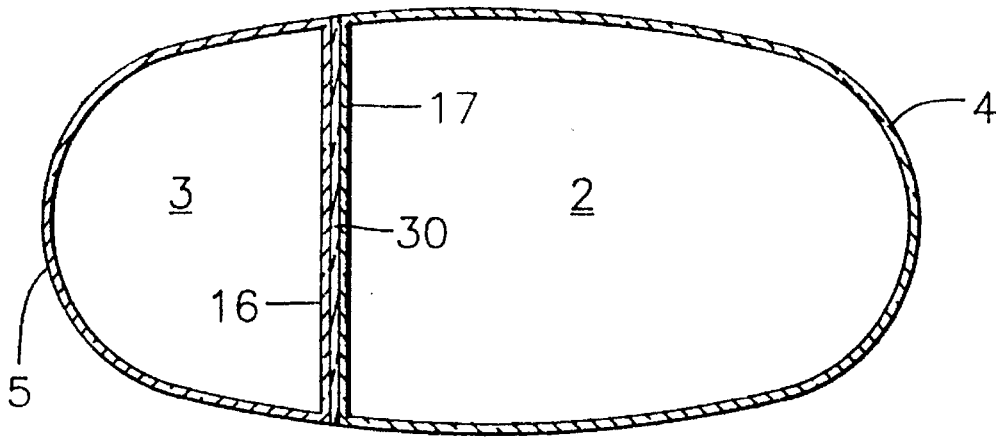
FIG. 5 is a cross-sectional view on the line V—V in FIG. 1.
Figure 6:
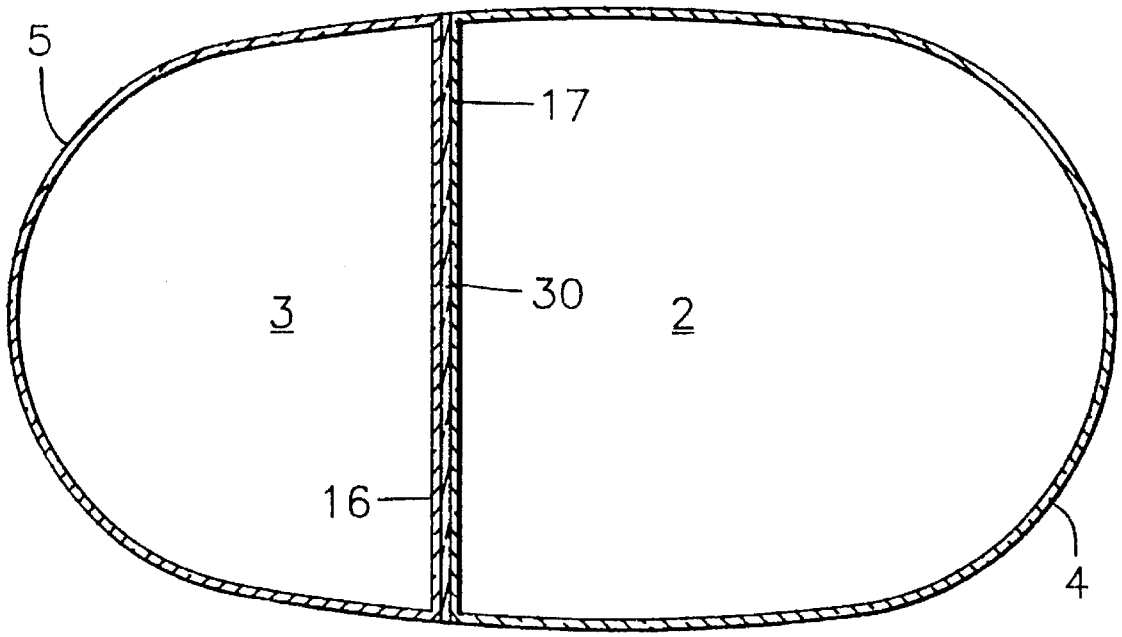
FIG. 6 is a cross-sectional view on the line VI—VI in FIG. 1.

Referring to the drawings there is illustrated a beverage container according to the invention and indicated generally by the reference numeral 1. The container 1 comprises two separate compartments 2,3 defined by sub-containers namely a first bottle 4 and a smaller bottle 5 which in this case are separately formed and subsequently bonded together, for example, by a suitable adhesive 30.

Each of the bottles 4, 5 comprises respective base portions 10, 11 body portions 12, 13 and neck portions 14,15. The body portions 12, 13 and neck portions 14, 15 include substantially flat axially extending mating surfaces 16,17 along which the bottles are bonded by the adhesive 30. The capacities of the bottles 4,5 are in this case different, the fill ratio of the larger to the smaller bottles being approximately 2:1.

The neck portions 14, 15 of the bottles each include a screw threaded portion 19, 20 to receive screw type closures (not shown).

The body portions 12, 13 of the bottles include recess portions 22, 23 on both sides of the container 1 to accommodate a display label (not shown) which extends over at least part of the joint between the bottles 2,3 in use.

The base 11 of the smaller bottle 3 is spaced slightly above the base 10 of the larger bottle 2 so that in use, the base portion 10 of the larger bottle 2 forms the standing surface for the container 1. This has the effect of stabilising the container as the entire load is on the larger base preventing any rocking that might occur if the bottles 4,5 were of the same height and not sufficiently accurately bonded together.

Preferably the bottles are of standard flint or clear glass and are each separately manufactured in two part moulds and subsequently bonded along laterally extending surfaces by an adhesive which is curable by ultra violet light. The adhesive may be applied at appropriate spaced-apart locations along one or both flat mating surfaces 16, 17 of the bottles.

The bottles 2, 3 contain different beverages. For example, the larger bottle 4 may contain a first dark beverage such as a dark coffee or chocolate liqueur beverage. The second bottle 5 of a smaller capacity may contain a light coloured beverage such as a white cream liqueur. In use, a closure for the larger bottle 4 is first removed and the beverage is poured into a suitably sized glass until the glass is approximately two-thirds filled with the chocolate or coffee liqueur from the compartment 2. The closure is then replaced and the second closure associated with the smaller bottle 5 is removed allowing the white cream liqueur to be poured from the bottle 5 down the side of the glass. Because the liqueurs are from single containers they may be relatively easily dispensed in correct proportions. A possible indicator that the correct amount of liqueur is being dispensed from each compartment 2, 3 is provided by the levels of the liquid remaining the compartments. As liqueurs are poured from the compartments the levels of the liquids remaining in the compartments drops at the same rate.

The invention is not limited to the embodiments hereinbefore described and may be varied in both construction and detail.

We claim:

1. A container for liquid beverages comprising a first glass bottle for one beverage;

a second glass bottle for another beverage;

the bottles being of different capacities and comprising a smaller capacity bottle and a larger capacity bottle, the capacities of the respective bottles being selected to provide an indicator means that required amounts of liquid beverage have been dispensed from the bottles, said indicator means comprising the level of liquid beverage remaining in each bottle;

the bottles each comprising a base portion;

a body portion; and a neck portion for receiving a closure, said neck portion being upstanding from said body portion;

the body portions providing substantially all of the different capacities between the bottles;

the body portions and neck portions having substantially flat axially extending mating surfaces; and an adhesive bonding the mating surfaces together to form a joint between the bottles, said base portion of said smaller capacity bottle being spaced upwardly from said base portion of said larger capacity bottle so that a load of the container is supported by said base portion of said larger capacity bottle to stabilize the container and prevent any rocking that might occur if the bottles were of the same height and insufficiently accurately bonded together.

2. A container as claimed in claim 1, wherein the body portions include mating recess portions which accommodate a display label which extends over at least part of the joint between the bottles.

3. A container as claimed in claim 2, wherein the body portions each have opposite sides and the recess portions are provided on both of said opposite sides of the body portions.

4. A container as claimed in claim 1, wherein the capacity of the larger capacity bottle is two times the capacity of the smaller capacity bottle.

5. A container as claimed in claim 3 wherein the capacities of the respective bottles are selected so that the levels of the liquid beverages drop at the same rate when the required amounts thereof have been dispensed.

6. A container for liquid beverages comprising a first glass bottle for one beverage;

a second glass bottle for another beverage;

the bottles being of different capacities and comprising a smaller capacity bottle and a larger capacity bottle, the capacities of the respective bottles being selected to provide an indicator means that required amounts of liquid beverage have been dispensed from the bottles, said indicator means comprising the level of liquid beverage remaining in each bottle being indicative of predetermined amounts of liquids being dispensed from each bottle with a reduction of liquid to the same level in each bottle evidencing the removal of liquids at a predetermined proportion;

the bottles each comprising a base portion;

a body portion; and a neck portion for receiving a closure, said neck portion being upstanding from said body portion;

the body portions providing substantially all of the different capacities between the bottles;

the body portions and neck portions having substantially flat axially extending mating surfaces; and an adhesive bonding the mating surfaces together to form a joint between the bottles, said base portion of said smaller capacity bottle being spaced upwardly from said base portion of said larger capacity bottle so that a load of the container is supported by said base portion of said larger capacity bottle to stabilize the container and prevent any rocking that might occur if the bottles were of the same height and insufficiently accurately bonded together.

* * * * *